United States Patent [19]

Koran et al.

[11] 4,309,873

[45] Jan. 12, 1982

[54] METHOD AND FLOW SYSTEM FOR THE CONTROL OF TURBINE TEMPERATURES DURING BYPASS OPERATION

[75] Inventors: Kenneth W. Koran, Ballston Lake; William T. Parry, Saratoga Spring, both of N.Y.

[73] Assignee: General Electric Company, Schenectady, N.Y.

[21] Appl. No.: 105,019

[22] Filed: Dec. 19, 1979

[51] Int. Cl.[3] ..... F01K 13/00

[52] U.S. Cl. ..... 60/646; 60/652; 60/662; 60/657

[58] Field of Search ..... 60/652, 653, 646, 657, 60/662, 663, 666, 677, 679

[56] References Cited

U.S. PATENT DOCUMENTS

| | | | |
|---|---|---|---|
| 3,919,846 | 11/1975 | Lecocq | 60/657 |
| 4,118,935 | 10/1978 | Andersson | 60/662 |
| 4,132,076 | 1/1979 | Weiss | 60/646 |
| 4,254,627 | 3/1981 | Gruber et al. | 60/646 |

FOREIGN PATENT DOCUMENTS

| | | | |
|---|---|---|---|
| 580336 | 11/1977 | U.S.S.R. | 60/646 |

OTHER PUBLICATIONS vol. 35, *Proceedings of the American Power Conference*, "Bypass Stations for Better Coordination Between Steam Turbine and Steam Generator Operation"-P. Martin et al.

*Primary Examiner*—Allen M. Ostrager

*Attorney, Agent, or Firm*—Ormand R. Austin; John F. Ahern

[57] ABSTRACT

Method and apparatus to limit and control rotational loss heating such as occurs in a large steam turbine in the bypass mode of operation under no-load and low-load operating conditions. According to the invention, a portion of the high pressure bypass steam is admitted to the lower pressure sections of the turbine to provide motive fluid for driving the turbine while, simultaneously, a second portion of the high-pressure bypass steam is admitted to the high-pressure section of the turbine in a reverse-flow direction to pass backwards therethrough and limit the rotational loss heating. The two flows may be proportioned to control rotational loss heating in both the high-pressure and lower pressure sections of the turbine. A reverse-flow valve and a ventilator valve are provided for routing the reverse-flow of steam.

9 Claims, 1 Drawing Figure

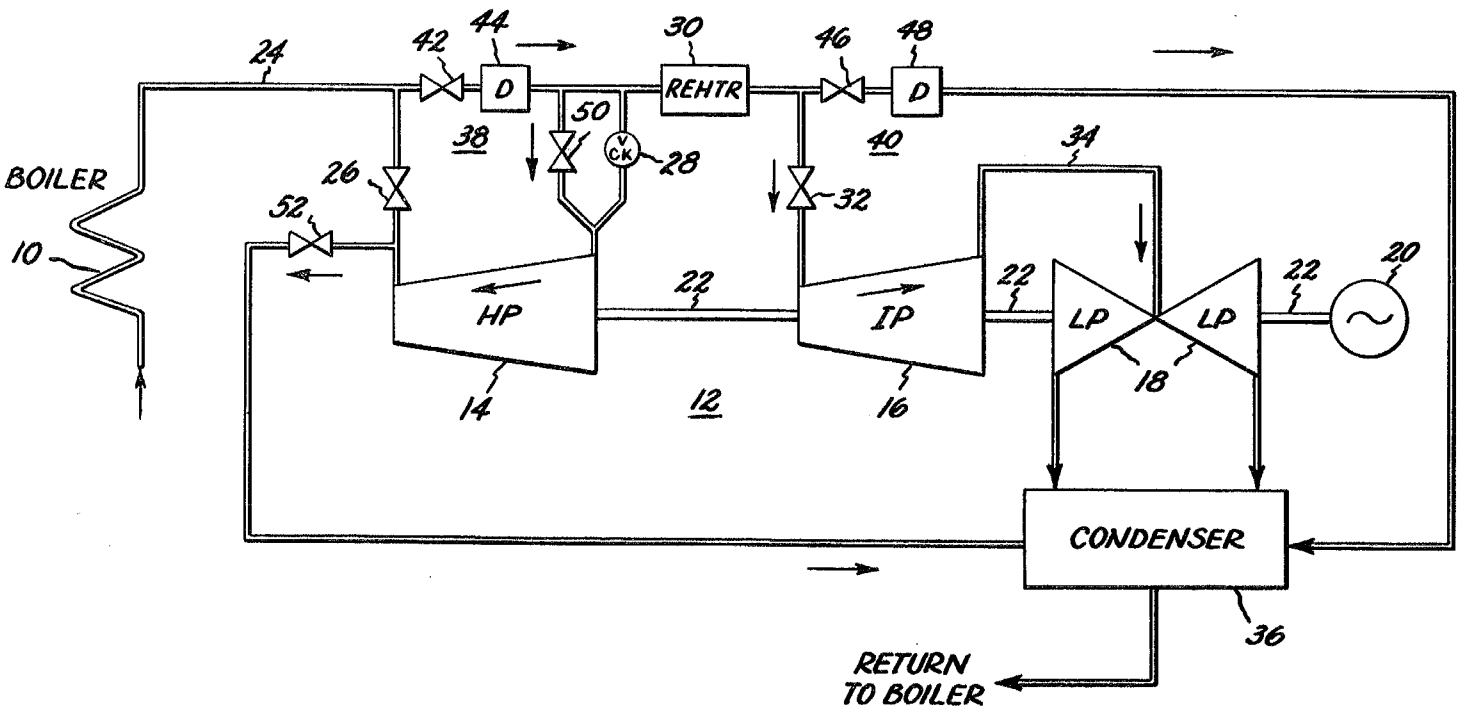
20
22
LP
18
LP
CONDENSER
36
34
22
TP
16
RETURN
TO BOILER
48
D
40
46
32
REHTR
30
28
22
12
50
44
D
38
HP
14
42
26
52
24
BOILER
10

METHOD AND FLOW SYSTEM FOR THE CONTROL OF TURBINE TEMPERATURES DURING BYPASS OPERATION

This invention pertains to steam turbines operable in a steam bypass mode and, in particular, to a steam flow system and to a steam flow method which permit bypass mode operation in a manner that avoids the overheating and excessive thermal stresses that otherwise result from rotation loss heating.

BACKGROUND OF THE INVENTION

Operating a large electric utility type steam turbine in a steam bypass mode entails the use of bypass valving systems to shunt steam around sections of the turbine whenever the load demand is such that the boiler is producing more steam than is required to support the load. The principal advantage of the bypass mode of operation is that the boiler may be operated at high level of output independently of the turbine's demand for steam which, in turn, is a reflection of demand for electrical energy. Other advantages inherent in a bypass mode of operation include the ability to quickly follow changes in load demand, the ability to more rapidly start the turbine, and the avoidance of boiler tripout upon sudden loss of load.

A problem encountered in the bypass mode of operation, however, and for which a solution has been sought by those skilled in the art, is the potentially damaging increase in temperature which can occur within the turbine sections as a result of rotational loss heating under no-load and low-load operating conditions. This heating effect, also commonly referred to as windage loss heating, is due to the friction between the steam and the turbine rotor blading occurring at or near synchronous speeds, and is pronounced in the bypass mode of operation because of the high back pressure resulting from the bypass steam flow and because of the relatively low flow of steam required to pass through the turbine when it is under very light load. The severity of the problem depends upon the rated power capacity of the turbine; the greater the power capability the higher the turbine temperatures are likely to become during these low load conditions. Windage losses at the exhaust end of the high-pressure (HP) section of a turbine can elevate the temperature to an extent that the turbine structure is subjected to excessive thermal stress, resulting in permanent structural damage.

The problem is accentuated by the fact that, as the turbine takes on more load and therefore more steam from the bypass system, the windage losses will be cut sharply and the turbine actually cooled by the increased steam flow. This sudden reversal of temperature puts a severe and sharp stress upon the turbine metal and may cause permanent deformation or cracking thereof.

With the present trend to larger, more efficient power-generating units, and with heightened interest in the bypass mode of turbine operation, solutions to the problem of rotational loss heating have been eagerly sought. However, an entirely satisfactory solution to the problem has not heretofore been available.

One previous approach to the problem, as exemplified by U.S. Pat. No. 4,132,076 entitled "Feedback Control Method for Controlling the Starting of a Steam Turbine Plant" has been to devise a rather elaborate and complicated feedback control system with which a greater quantity of steam is caused to pass through the high-pressure section of the turbine than through the lower pressure sections. This is accomplished by having a control system in which one subsystem provides control of the bypass and steam admission valves at low and no-load conditions and a second subsystem which provides control at elevated loading. While there is thus provided an acceptable means for dealing with the problem of rotational loss heating, other and simpler methods and apparatus are desired.

Accordingly, it is an object of applicants' invention to provide a simple, satisfactory solution to the problem of rotational loss heating such as may occur in steam turbines during bypass mode operation.

SUMMARY OF THE INVENTION

The method and apparatus of the present invention limit and control rotational loss heating by admitting a portion of the high-pressure bypass steam to the lower pressure sections of the turbine in sufficient quantity to provide motive fluid for driving the turbine. Simultaneously, a second portion of the steam bypassed around the high-pressure section is admitted to the high-pressure sections of the turbine in a reverse-flow direction to pass backwards therethrough. In other words, the turbine is driven entirely by the portion of HP bypass steam admitted to the lower pressure sections of the turbine while a second portion of the HP bypass steam is admitted in reverse-flow to the HP section of the turbine to create a braking and cooling effect. The flows may be proportioned to prevent overheating in both the HP and lower pressure (LP) sections.

A reverse-flow valve is provided to admit the reverse-flow, or cooling steam, to the HP section of the turbine and a ventilator valve is provided to discharge the cooling steam to the atmosphere or to the condenser associated with the turbine.

When load on the turbine has been increased to the point at which steam flow in the forward direction of the HP section can be established without excessive temperatures in either the HP or LP sections, the ventilator valve is closed and the conventional control valve will open. This valving action occurs in a relatively short time, i.e., a matter of seconds.

BRIEF DESCRIPTION OF THE DRAWING

While the specification concludes with claims particularly pointing out and distinctly claiming the subject matter regarded as the invention, the invention will be better understood from the following description taken in connection with the accompanying FIGURE which schematically illustrates the method and flow system of the present invention.

DETAILED DESCRIPTION OF THE INVENTION

The FIGURE illustrates the invention within the context of an electric power-generating station in which a boiler 10 supplies steam as motive fluid for a turbine 12 comprised of a high-pressure (HP) turbine section 14, an intermediate pressure section (IP) 16, and low-pressure (LP) section 18. The turbine sections 14, 16, and 18 are shown tandemly coupled to each other and to electric power generator 20 by a shaft 22, although many other turbine shaft arrangements are possible.

With turbine 12 operating under a substantial load and able to utilize the entire output of boiler 10, the steam flow path is as follows. From boiler 10 and conduit 24, steam enters HP section 14 through valve 26.

Although shown schematically as a single valve to illustrate and explain the invention, valve 26 is a composite representation of a plurality of valves, including the stop and admission control valves commonly used in practice and necessary for turbine operation. Steam exhausted from HP section 14 passes through check valve 28, steam reheater 30, and into IP section 16 through valve 32. Valve 32 is a composite representation of the usual stop and intercept valves which control the flow of steam to the IP section 16. Steam exhausted from IP section 16 passes by crossover conduit 34 to the LP section 18 of turbine 12 and then is exhausted to condenser 36 for ultimate recycle to the boiler 10. In each section 14, 16 and 18 of turbine 12, a portion of the energy contained in the steam is released to drive the turbine 12 and its load as represented by electrical generator 20.

At lesser loads, whenever the demand for electrical energy from generator 20 is less, and with boiler 10 producing steam in excess of that required to support the load, the excess steam is shunted around the turbine 12 by high-pressure (HP) bypass system 38 and a lower pressure bypass system 40. The HP bypass system 38 includes HP bypass valve 42 and desuperheater 44; the lower pressure bypass system 40 includes bypass valve 46 and desuperheater 48. In the bypass mode of operation, the portion of steam from boiler 10 required for the HP section 14 is taken from conduit 24 and the balance passes around the HP section 14 by way of HP bypass 38. The steam thus bypassed and that exhausted from the HP section 14 are rejoined to flow through reheater 30.

Steam from the reheater 30 is similarly split, with the portion necessary for IP section 16 and LP section 18 being taken through valve 32 and the balance being bypassed through bypass system 40 to condenser 36.

In the bypass mode of operation as described above, and whenever the turbine 12 is being started up, or whenever it is supporting a small load, most of the steam is bypassed and relatively little is taken as motive fluid for the turbine 12. Under these conditions a considerable back pressure is created at the low temperature side of reheater 30 and on the exhaust end of HP section 14. The combination of high pressure and low steam flow in the HP section 14 gives rise to the rotational loss heating which is potentially destructive to the turbine 12. In this situation, the spinning turbine blades are imparting energy to the steam rather than extracting energy therefrom. The temperature of the steam in the HP section 14 may thus be increased to a point at which excessive thermal stress to the turbine results.

According to the present invention, to eliminate this effect, (which occurs under low and no load conditions, including turbine startup), valve 26 is kept closed to prevent the forward flow of steam through HP section 14 and the output of turbine 12 is supported by steam admitted to IP section 16 and LP section 18 through valve 32. Simultaneously, reverse flow valve 50 is open to admit a portion of the steam from the HP bypass system 38 to the HP section 14 to flow therethrough in a reverse-flow direction. Ventilator valve 52 is also open to discharge the reverse-flow steam from the HP section 14 to the condenser 36. However, since the reverse steam flow is relatively small it may be simply disposed of without significant economic loss. The cooling steam path through reverse-flow valve 50 and ventilator valve 52 comprises a cooling steam system or subsystem and may be so referred to herein.

The cooling steam, passing backwards through the turbine HP section 14, is effective to remove the rotational loss heating and prevent any likelihood of overheating. In the FIGURE, arrows indicate the steam flow paths as the cooling steam system is being utilized.

It will be recognized that the reverse flow of steam results in a temperature gradient, or temperature distribution, across the HP section 14 that more nearly matches the temperature distribution which the HP section 14 has under normal, loaded conditions. That is, as the HP section 14 is producing power and the steam flow is in the forward direction, the temperature gradient is negative along the steam path. A similar gradient is established under reverse-flow conditions and, in fact, the reverse steam flow may be adjusted to vary the gradient. This is highly advantageous since the sudden cooling shock which would ordinarily accompany increased steam flow with increasing load is avoided.

Desuperheater 44 provides cooling of the steam in the HP bypass system 38 and therefore aids the reverse flow cooling effect. In a preferred embodiment of the invention, the temperature within the HP section 14 is controlled by varying the temperature of the cooling steam through regulation of the desuperheater 44.

In another embodiment, the ventilator valve 52 is an adjustable, or a control-type valve, and is used to control the reverse flow of steam and therefore the maximum temperature and the temperature gradient across HP section 14. In yet another embodiment, reverse flow valve 50 is an adjustable or control-type valve to control the flow of steam and the resulting temperature within HP section 14. Although each embodiment of the invention is not specifically illustrated separately, those of ordinary skill in the art will clearly recognize the adaptations required to achieve such embodiments.

The lower pressure sections 16 and 18 of turbine 12 are also subject to overheating due to rotational loss heating under very low steam flow conditions. Such heating is also overcome by the present invention. This is achieved by increasing the flow of steam in the IP and LP sections 16 and 18 by an amount sufficient to reduce the rotational loss heating therein and offsetting the increased power produced by the added flow by increasing the reverse flow of steam to HP section 14. Since the reverse-flow steam has a braking effect on the turbine 12, the net output power is unchanged.

Operation

It will be useful to describe the startup procedure of the power plant as illustrated in the FIGURE to provide further description of the principles and advantages of the invention.

With the turbine 12 shut down and boiler 10 producing a large quantity of steam, valve 26 is closed and bypass valves 42 and 46 are open in order to bypass all the steam to the condenser 36. Startup of the turbine 12 is begun by opening valve 32 to admit steam to the lower pressure sections 16 and 18. Valve 26 remains closed and the entire turbine output is thus generated by the steam admitted to the lower pressure sections 16 and 18 of the turbine 12. Simultaneously, desuperheated steam is admitted to the HP section 14 through the reverse-flow valve 50 and flows backwards through the HP stages taking away the windage losses. This steam passes through a ventilator valve 52 ahead of the first stage of the HP section 14 and is then dumped to the condenser 36. The reverse-flow, cooling steam increases in temperature as it flows through the HP section 14. The actual temperature distribution can be varied by admitting more or less cooling steam, or preferably, by varying the temperature of the cooling steam through control of desuperheater 44.

When load on the turbine 12 is increased to the point at which steam flow in the forward direction of the HP section 14 can be established without excessive temperatures occurring either in the HP section 14 or the lower pressure sections 16 and 18, then in a relatively short time (a matter of seconds) the ventilator valve 52 can be closed and valve 26 opened. The opening of valve 26, of course, will be sufficient to allow enough steam to flow into the HP section 14 to prevent excessive temperatures.

While a preferred and alternative embodiments of the invention have been described, it will occur to others of ordinary skill in the art to make adaptations of this invention which will remain within the concept and scope thereof and will not constitute a departure therefrom. Accordingly, it is intended that the invention be not limited by the details in which it has been described but that it encompass all within the purview of the following claims.

What is claimed is:

1. A method for operating a steam turbine adapted for bypass mode operation in conjunction with a steam generating means, the turbine having a high-pressure (HP) section, an HP bypass system, at least one lower pressure section, and a lower pressure bypass system, said method comprising the steps of:

bypassing a flow of steam from said steam generating means around said HP section;

admitting a first portion of said bypassed steam to said lower pressure section in a forward flow direction to provide motive fluid for driving the turbine, said first portion of steam being admitted at a rate sufficient to limit rotation loss heating in said lower pressure section; and admitting a second portion of said bypassed steam to said HP section to pass therethrough in a reverse-flow direction to limit rotation loss heating in said HP section and to provide an offsetting braking effect for said first portion of steam admitted to said lower pressure section in excess of that required for driving the turbine.

2. The method of claim 1 further including the steps of:

desuperheating said bypassed steam prior to admitting said second portion of bypassed steam to said HP section; and reheating said first portion of bypassed steam prior to admitting said first portion to said lower pressure section.

3. The method of claims 1 or 2 wherein the flow rate of said second portion of bypassed steam is regulated to determine the temperature gradient along the steam path through said HP section.

4. The method of claim 2 wherein said desuperheating step provides temperature regulation of said bypassed steam for determining the temperature gradient along the steam path through said HP section.

5. In combination with a steam turbine of the type having a high-pressure (HP) section, at least one lower pressure section, a steam conduit interconnecting the HP section to the lower pressure section through a steam reheater, at least one control valve for regulating the forward flow of steam to the HP section, and an intercept valve for regulating the flow of steam to the lower pressure section, a steam flow system for control of rotation loss heating, comprising:

an HP bypass subsystem for passing steam around said high-pressure section, said HP bypass subsystem including a bypass valve for regulating steam flow;

a lower pressure bypass subsystem for passing steam around said lower pressure section, said lower pressure bypass subsystem including a bypass valve for regulating steam flow;

a cooling steam subsystem for passing steam flow in a reverse direction through said HP section, said cooling steam subsystem including a reverse-flow valve through which reverse steam flow is admitted to said HP section from said HP bypass subsystem, a check valve fluidly connected in parallel with said reverse-flow valve and adapted to pass steam flow in the forward direction from said HP section and to block steam flow in the reverse direction to said HP section, and a ventilator valve through which reverse steam flow is discharged from said HP section.

6. The combination of claim 5 wherein said ventilator valve is adjustable for setting the steam flow rate in said reverse direction to determine the temperature gradient developed across said HP section.

7. The combination of claim 5 wherein said ventilator valve is an automatic control valve for regulating the steam flow rate in said reverse direction to determine the temperature gradient developed across said HP section.

8. The combination of claim 5 wherein said reverse-flow valve is adjustable, for setting the steam flow rate in said reverse direction to determine the temperature gradient developed across said HP section.

9. The combination of claims 5, 6, 7 or 8 wherein said HP bypass subsystem further includes desuperheating means for desuperheating steam flowing in said HP bypass subsystem.

* * * * *